US008777306B2

(12) United States Patent
Rahm

(10) Patent No.: US 8,777,306 B2
(45) Date of Patent: Jul. 15, 2014

(54) COMBINATION FOLDABLE CHAIR AND ROLLING TRANSPORT

(76) Inventor: Brenda D. Rahm, Warrensburg, MO (US)

( * ) Notice: Subject to any disclaimer, the term of this patent is extended or adjusted under 35 U.S.C. 154(b) by 447 days.

(21) Appl. No.: 13/292,831

(22) Filed: Nov. 9, 2011

(65) Prior Publication Data

US 2013/0113248 A1 May 9, 2013

(51) Int. Cl.

| | |
|---|---|
| ***A47C 7/62*** | (2006.01) |
| ***A47C 13/00*** | (2006.01) |
| ***A47C 4/00*** | (2006.01) |
| ***B62B 1/04*** | (2006.01) |

(52) U.S. Cl.

USPC ..... 297/129; 297/17; 297/188.04; 190/8; 280/47.25

(58) Field of Classification Search

USPC ..... 297/17, 129, 188.04, 217.1; 224/153, 224/155; 190/8; 280/47.25, 47.34, 47.131, 280/63, 643, 648

See application file for complete search history.

(56) References Cited

U.S. PATENT DOCUMENTS

| | | | | | |
|---|---|---|---|---|---|
| 3,227,467 | A | * | 1/1966 | Fugitt, Sr. | 280/47.25 |
| 4,340,132 | A | * | 7/1982 | Cerna | 190/18 A |
| 4,733,905 | A | * | 3/1988 | Buickerood et al. | 297/129 |
| 5,056,804 | A | * | 10/1991 | Wilson et al. | 280/30 |
| 5,273,307 | A | * | 12/1993 | Jarke et al. | 280/643 |
| 5,290,049 | A | * | 3/1994 | Crisp et al. | 280/30 |
| 5,375,277 | A | * | 12/1994 | Carr et al. | 5/625 |
| 5,403,022 | A | * | 4/1995 | Snider | 280/30 |
| 5,478,096 | A | | 12/1995 | Ting | |
| 5,505,524 | A | * | 4/1996 | Drumwright | 297/440.24 |
| 5,507,508 | A | * | 4/1996 | Liang | 280/37 |
| 5,899,467 | A | * | 5/1999 | Henkel | 280/47.25 |
| 5,988,657 | A | * | 11/1999 | Henkel | 280/47.25 |
| 6,789,809 | B2 | * | 9/2004 | Lin | 280/47.25 |
| 6,932,427 | B2 | | 8/2005 | Tamura | |
| 6,976,685 | B1 | * | 12/2005 | King et al. | 280/30 |
| 6,986,518 | B1 | * | 1/2006 | Besaw | 280/30 |
| 7,163,262 | B2 | * | 1/2007 | Anglin | 297/217.1 |
| 7,293,792 | B2 | * | 11/2007 | Wilson | 280/647 |
| 7,316,407 | B1 | | 1/2008 | Elden et al. | |
| 7,389,997 | B2 | * | 6/2008 | Johnson et al. | 280/47.19 |
| 7,438,355 | B2 | | 10/2008 | Pedemonte | |
| 7,523,949 | B1 | * | 4/2009 | Galfin | 280/35 |
| 7,644,981 | B2 | * | 1/2010 | Hensley | 297/17 |
| 7,818,840 | B2 | * | 10/2010 | Barnett et al. | 5/627 |
| 7,918,502 | B2 | * | 4/2011 | Bacon | 297/217.1 |
| 8,016,089 | B1 | * | 9/2011 | McNichols | 190/8 |
| 8,286,767 | B2 | * | 10/2012 | Malinowski | 190/8 |

(Continued)

*Primary Examiner* — David R Dunn
*Assistant Examiner* — Richard Lowry
(74) *Attorney, Agent, or Firm* — Lathrop & Gage LLP

(57) ABSTRACT

A foldable chair, operable between a seating configuration and a rolling transport configuration, the foldable chair comprising a plurality of legs with a roller secured to the distal end of each leg and the proximal end of each leg secured to a column base. Extending from the column base is a column with a first and second end, the column first end secured to the column base and the second end of the column secured to a first platform or seat cushion. A second platform extends downwardly from the first platform for attaching a carrying case. Also included is a backrest rotatably secured to the first platform such that when the backrest is perpendicular to the first platform two roller elements are fully shrouded. When the backrest is rotated 90 degrees and disposed substantially parallel to the seat cushion the roller elements are exposed for rolling contact with the ground surface.

34 Claims, 8 Drawing Sheets

(56) References Cited

U.S. PATENT DOCUMENTS

| | | | | |
|---|---|---|---|---|
| 8,567,860 | B2 * | 10/2013 | Jue | 297/19 |
| 8,573,454 | B2 * | 11/2013 | Talavera Tolentino | 224/155 |
| 2002/0014753 | A1 * | 2/2002 | Cheng | 280/47.26 |
| 2002/0180247 | A1 * | 12/2002 | Lombardi | 297/217.1 |
| 2009/0079244 | A1 * | 3/2009 | Kelleher | 297/257 |
| 2009/0159385 | A1 * | 6/2009 | Poissant et al. | 190/8 |
| 2010/0072012 | A1 * | 3/2010 | Malinowski | 190/8 |
| 2010/0327562 | A1 * | 12/2010 | Kasuya et al. | 280/651 |
| 2012/0267875 | A1 * | 10/2012 | Mazar et al. | 280/643 |
| 2012/0274103 | A1 * | 11/2012 | Kenttamaa-Squires et al. | 297/129 |

* cited by examiner

COMBINATION FOLDABLE CHAIR AND ROLLING TRANSPORT

FIELD OF THE INVENTION

The present invention relates generally to a combined foldable chair and rolling transport apparatus which may be used as a comfortable seat or readily converted for conveying a load.

BACKGROUND OF THE INVENTION

Portable chairs for recreational and commercial uses have long been known. What has not been known is a highly functional chair that captures comfort, compactness, portability and the capacity to convey a load such as supplies or equipment. Illustrative of the utility of the foldable chair and rolling transport, but which should not be construed as limiting of its applicability, is to provide quilters or hobbyists with a comfortable chair to use when they travel for a class or when they travel to quilt at a retreat. The problem that is solved with the chair is that when a hobbyist arrives to take an all-day or several-day sewing, quilting or other similarly topical class, the individual is often placed at a table that is too high with a rigid chair that is too low for comfortable sewing or quilting. Also solved is the problem of carrying a heavy sewing machine and miscellaneous supplies.

At home, the hobbyist often has a sewing machine in a cabinet that places the sewing machine at a preset comfortable height. If the hobbyist does not have a cabinet for his or her machine, then the hobbyist usually has a chair that is adjustable so that she can increase her seat height to accommodate the sewing machine on a table. At a classroom setting, though, the tables are often times too high and the chairs are generally non-adjustable and often times are too low. The hobbyist therefore ends up sitting all day in a chair that is too low for a table that is too high when a sewing machine is placed on it. Also, the chairs provided are normally metal folding chairs or plastic chairs which tend to be very uncomfortable for sitting extended periods of time. An adjustable-height chair on rollers with a comfortable well cushioned seat is quite a luxury when sewing for many hours at a time. The quilter is usually required to get up and down numerous times during an hour to go to an ironing board and rollers at the end of the chair legs greatly facilitate the movement to and from the ironing board.

In addition to the height elevation feature, comfortable cushion and rollers, the foldable chair is designed to provide the hobbyist with a way to transport her equipment, such as a sewing machine, which may weigh in the range of 20 to 30 pounds. The sewing machine is placed into a rigid carrying case, along any other essential supplies and the case is secured into position on the chair so that the chair in its reconfigured position becomes a rolling transport for the encased equipment. When the hobbyist arrives at her destination, she removes the case and unfolds the chair and now has available a comfortable chair to use all day that is height adjustable thereby vastly improving her level of comfort while engaging in her hobby of choice, and she has been able to easily transport her sewing machine and supplies on the foldable chair.

Accordingly, there is a need for a foldable chair operable between a seating configuration and a rolling transport to facilitate ease of transport and use, while providing features directed to the conveyance of additional items. The present invention addresses these needs.

SUMMARY OF THE INVENTION

A combination foldable chair and rolling transport in accordance with the present disclosure includes a plurality of legs each with a roller secured to the distal end and the proximal end of each leg secured to a column base. The column base is in turn secured to a column that extends upwardly to a first platform. The second end of the column is secured to the first platform or cushioned seat and the cushioned seat houses at least one telescoping shaft with a handle for use when the foldable chair is in the rolling transport configuration. A second platform is secured to and is disposed beneath the first platform for use as a footrest when the foldable chair is in the seating configuration. Alternatively, when in the rolling transport configuration the second platform is used for securing a carrying case for item storage during rolling transport.

In one embodiment, a backrest is rotatably secured to the first platform. When the backrest is substantially perpendicular to the first platform seat cushion two wheels oppositely disposed and adjacent the backrest sides are fully shrouded, and when the backrest is rotated approximately 90 degrees and disposed substantially parallel to the first platform a portion of the wheels are unshrouded for rolling contact with the ground surface. When in a seating configuration, the two wheels are fully shrouded protecting the user from contact with any debris, such as mud, tar, snow and salt, that may adhere to the wheels during transport. The rolling transport configuration is sturdy and appropriate for pulling the chair up over curbs, stairs and utilizes two low friction replaceable strips on the backside surface of the backrest above the transport rollers to provide protection for the chair when it is pulled up curbs or stairs and to facilitate movement of the chair.

When the chair is in the rolling transport configuration and ready for placement in a trunk at least one, and preferably three, of the legs will freely rotate down thereby decreasing the overall width and height of the rolling transport, allowing the chair to fit into confined spaces such as the smallest of trunks. The legs pivot with gravity, and no special manipulation is required. When the rolling transport is rotated down onto the legs, the legs automatically open and support the chair.

A handle secured to telescoping members is utilized for pulling the rolling transport with carrying case secured to the second platform. When reconfigured to the seating configuration the telescoping handle is compressed and nests within the first platform obscured from view.

The chair is constructed from lightweight yet sturdy material thereby allowing the hobbyist to easily lift the foldable chair into his or her trunk or sport utility vehicle. The carrying case has been designed so that it will accommodate the largest of sewing machines. Special pockets will be in place to hold rotary cutters, rulers and small mats used in the quilting industry. The case will lock into place when it is on the chair so that if the chair were to twist sideways when being pulled up over a curb, the case will not fall off. The case provides extra protection for the quilter who is taking her sewing machine to a class, along with a way to easily carry it.

BRIEF DESCRIPTION OF THE DRAWINGS

These and other features, aspects and advantages of the present invention are described below with reference to drawings of a preferred embodiment, which is intended to illustrate, but not limit, the present invention. The drawings contain 14 figures.

DETAILED DESCRIPTION OF THE PREFERRED EMBODIMENT

Figure 1:
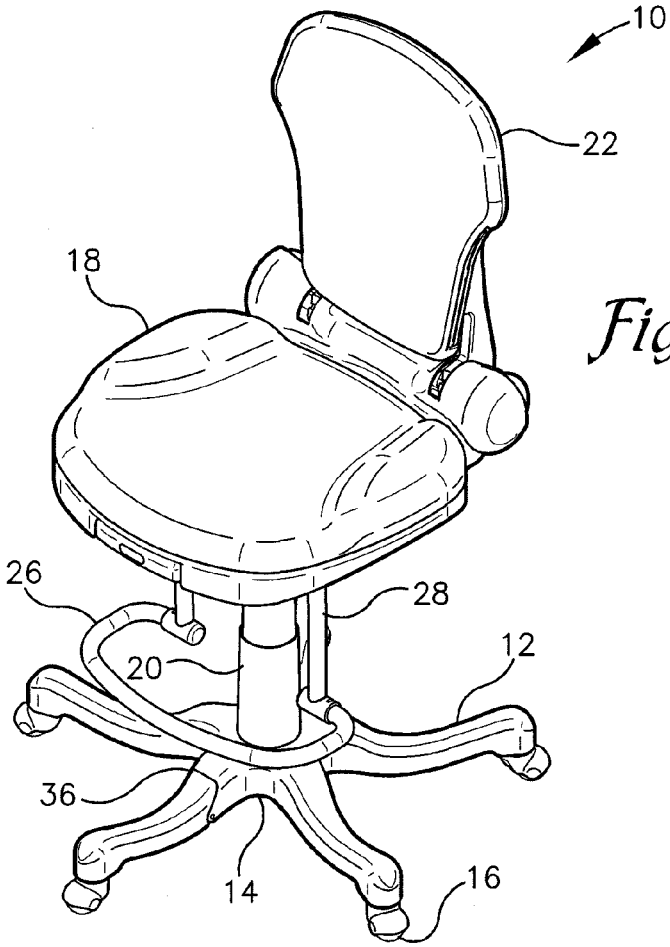
FIG. 1 is a perspective view of a foldable chair in a seating configuration.

FIG. 1 reveals the foldable chair 10 in its seating configuration with a plurality of legs 12 extending outwardly from a column base 14. At the distal end 13 of each leg 12 is a roller element 16 to facilitate omni-directional repositioning of the foldable chair by the user. The proximal end of each leg 12 is connected to the column base 14. At least one, and preferably two or more, of the legs 12 are pivotally secured to the column base 14 at a pivot point 36 so that when converted to the rolling transport configuration the legs 14 may be rotated downwardly to facilitate placement into a space of limited volume such as the trunk of a car. FIG. 1 also reveals a first platform 18, or seat cushion, positioned atop, secured to and supported by a support column 20. A backrest 22 is pivotally and adjustably secured to the first platform 18 by a pivot mechanism 24 which will be discussed in additional detail below. The backrest 22 serves to support the back of an individual seated in the foldable chair 10. The foldable chair in FIG. 1 also includes a second platform 26 that when the foldable chair is in the seating configuration would typically be used as a footrest. The second platform 26 is suspended beneath the first platform 18 by at least one, and preferably two support rods 28, that are secured to the underside of the first platform 18.

Figure 2:
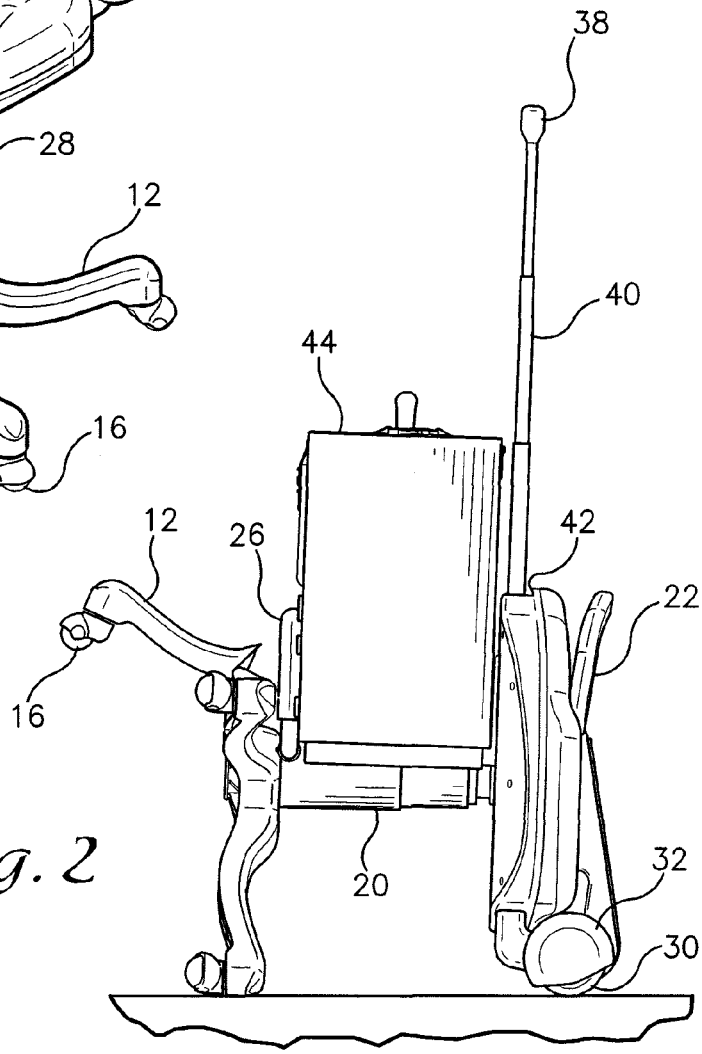
FIG. 2 is a side elevation view of a foldable chair in a rolling transport configuration with a carrying case loaded onto the rolling transport.

FIG. 2 reveals the foldable chair 10 in its rolling transport configuration. For purposes of conversion into the rolling transport position from the seating configuration a series of discrete steps are required. First, the pivot mechanism 24 is used to rotate the backrest 22 approximately 90 degrees from a vertical orientation to an orientation that is effectively parallel with the first platform 18 or seat cushion. The roughly 90° rotation of the backrest 22 atop the first platform 18 also serves to unshroud a wheel 30 on each side of the backrest 22. The roller cover 80 is secured to the first platform 18. Next the entire foldable chair assembly 10 is rotated by approximately 90 degrees wherein the unshrouded wheels 30 contact the ground surface. Also supporting the foldable chair 10 in this rotated configuration are the distal ends of at least two of the legs 12. As seen in FIG. 2, all except two of the roller elements 16 are rotated out of contact with the ground surface when the transport is in a stationary status. When in a rolling transport mode only the unshrouded wheels 30 will be in contact with the ground surface as the transport will be rotated by the user to facilitate walking with the transport.

Following rotation of the foldable chair and contact by the unshrouded wheels 30 with the ground surface, the handle 38 secured to the telescoping member 40 is extracted, as seen in FIG. 2, from the front slot 42 on the front of the first platform 18. The telescoping member 40 is fully enclosed within an internal space within the first platform 18. The telescoping member 40 may be comprised of a single telescoping rod element or alternatively with dual telescoping rod elements for improved structural rigidity. The telescoping member elements may be comprised of any durable and rigid material including metals and plastics that offer high tensile strength, light weight, wear resistance and low oxidation potential due to exposure to harsh environments and that may be finished to suit the preferences of the consuming public. At the end of the telescoping member 40 is a handle 38 that is sufficiently robust in configuration to withstand high grip pressures along with high torsional and tensile loads and that also provides a comfortable grip when the foldable chair 10 is utilized in the rolling transport configuration.

Figure 14:
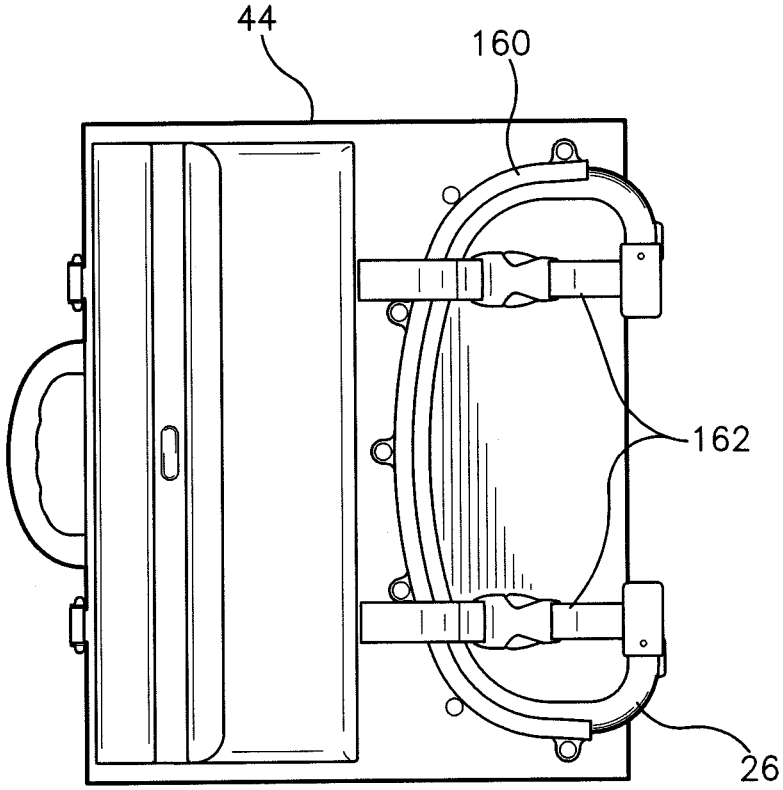
FIG. 14 is an elevation view of a carrying case with integral crown showing the lower platform inserted beneath the crown and straps securing the carrying case in position.

FIG. 2 also reveals the placement of a case 44, such as a carrying case or even a small suitcase on the support column 20. The carrying case is positioned between the second platform 26, or footrest, and the bottom 46 of the first platform 18 and rests securely on the support column 20 and remains balanced with the aid of the support rods 28. When in position between the lower shell cover 54 of the first platform 18 and the second platform 26 the carrying case is secured in position by an integrated locking mechanism, as seen in FIG. 14, for purposes of stabilizing the carrying case 44 when moving the rolling transport over uneven surfaces. The carrying case 44 will include a crown 160 that is formed consistent with the shape of and designed to accept the second platform 26 into the crown 160. Once the second platform 26 has been inserted into the crown 160 the case 44 is secured to the crown 160 with the assistance of at least two straps 162 integral to the carrying case.

Figure 3:
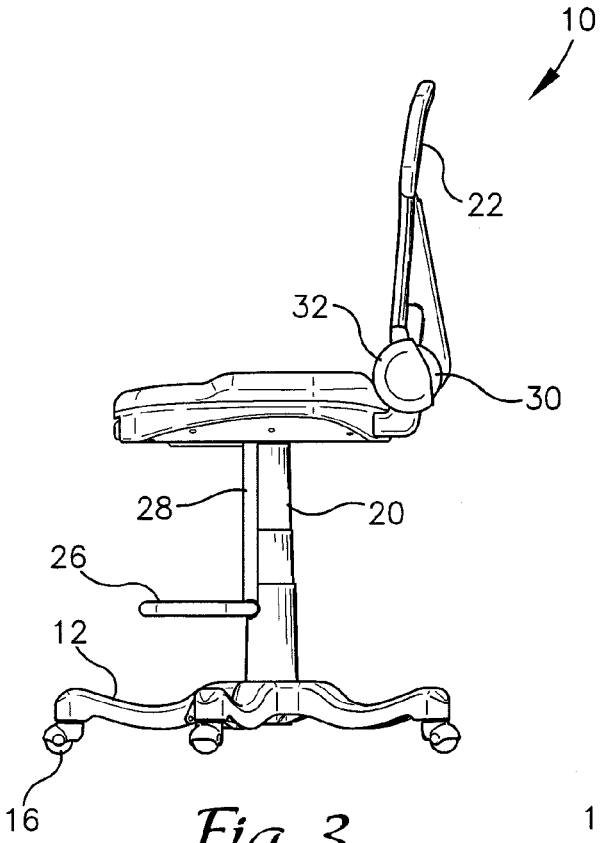
FIG. 3 is a side elevation view of a foldable chair in a seating configuration with the support column fully extended.
Figure 4:
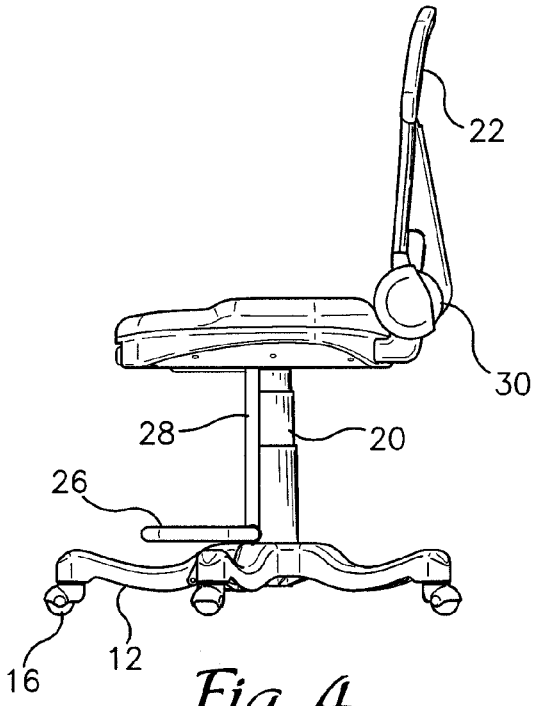
FIG. 4 is a side elevation view of a foldable chair in a seating configuration with the support column fully compressed.

FIGS. 3 and 4 reveal that the support column 20 is adjustable in height and utilizes a standard pneumatic or spring loaded telescoping mechanism that is well known in the art. The user of the foldable chair 10 can activate the support column 20 telescoping mechanism with the use of side lever that is commonly found on chairs in office settings. As is also seen in FIGS. 3 and 4, the distance between the bottom 46 of the first platform 18 and the second platform 26 or footrest, does not vary with changes in elevation of the support column 20. The rationale for this consistency is that unless the width of the carrying case 44 were to change, there is no need to alter the separation distance between the first 18 and second platforms 26.

Figure 5:
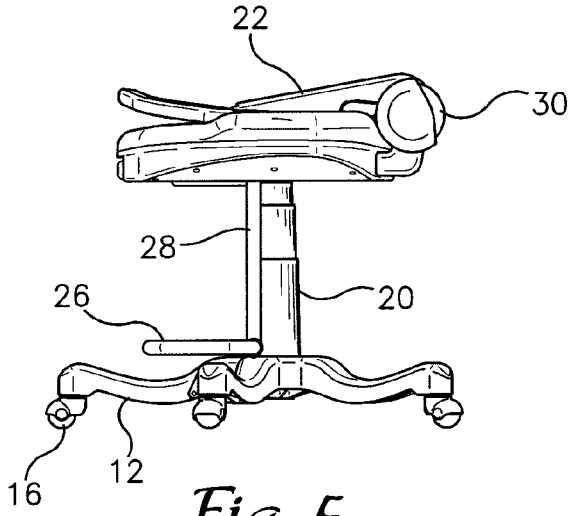
FIG. 5 is a side elevation view of a foldable chair with the backrest fully rotated downward.
Figure 12:
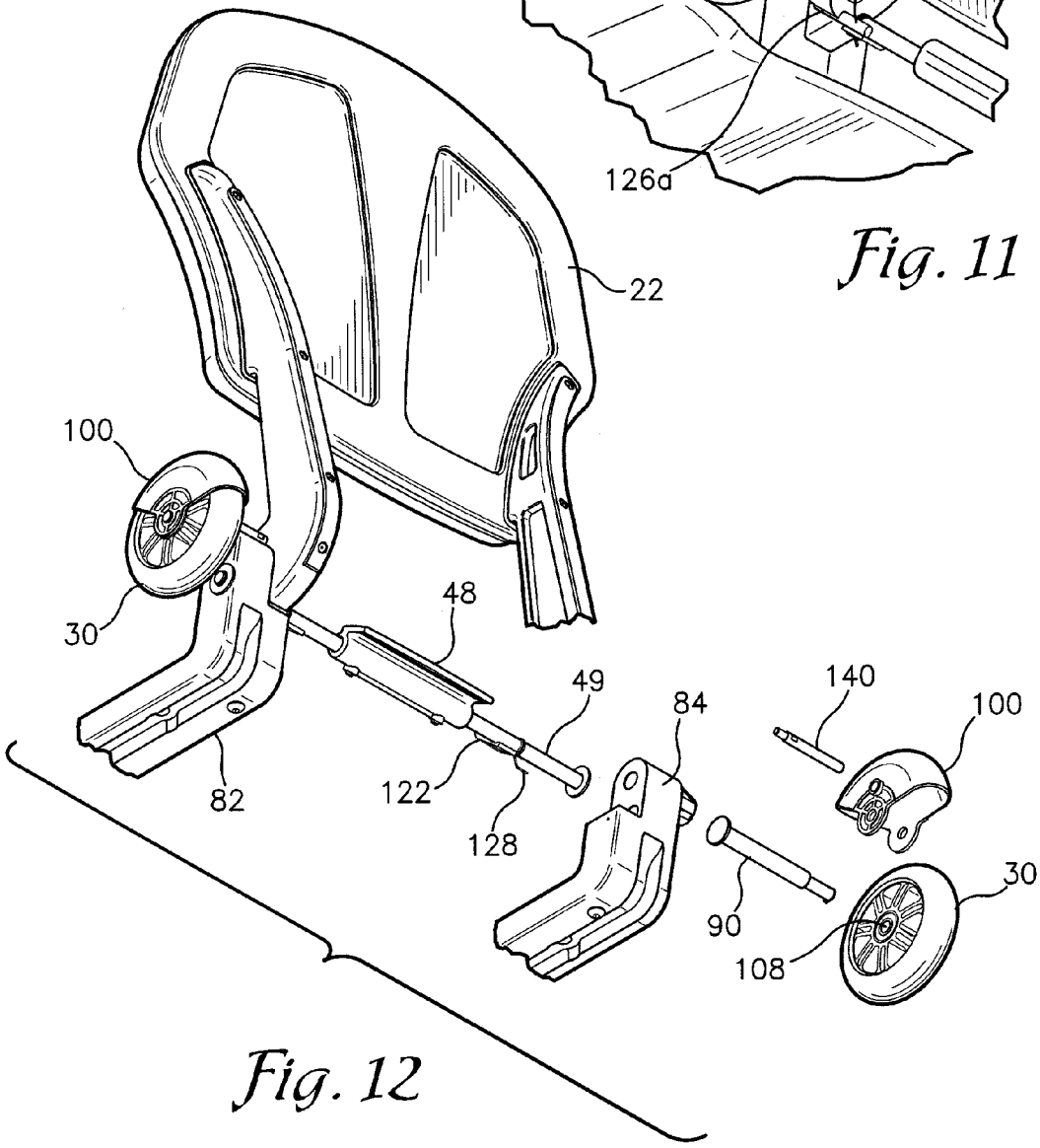
FIG. 12 is a bottom perspective view of the handle assembly, backrest brackets, wheel shroud and backrest.

FIG. 5 details the configuration of the chair 10 when the backrest 22 is rotated approximately 90 degrees to a position that is co-planar with the first platform 18, or seat cushion. The release handle 48, as best seen in FIG. 12, when rotated facilitates the release of the backrest 22 and allows the backrest to be rotated atop the seat cushion 18. As has been briefly discussed above and will be discussed in even greater detail below, the wheels 30 positioned at the base of the backrest 22 are fully shrouded when the backrest 22 is raised and the foldable chair is in the seating configuration. Since the wheel 30 may at times be pulled through less than pristine environments, such as snow, mud, road tar, etc., when serving as a rolling transport, the roller shrouds 32 serve to protect the user's clothes and appendages from debris when seated on the first platform 18 or moving about behind the chair 10. The innovative design of the shroud assembly allows the wheels 30 to be exposed only when the back rest 22 is lowered yet totally encapsulated thereby preventing the transfer of debris when in the seating configuration.

Figure 6:
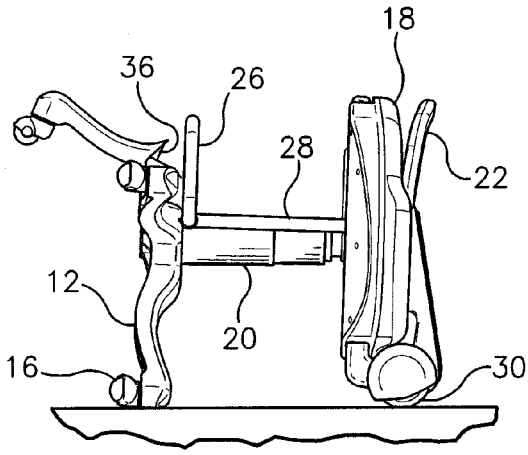
FIG. 6 is a side elevation view of a foldable chair partially converted to a rolling transport configuration after having been rotated about 90°.

FIG. 6 depicts the foldable chair in a rotated position revealing contact between the ground surface and the wheels 30 as well as contact by the distal end 13 of at least one leg 12. FIG. 6 also reveals the leg 12 proximal end pivot points 36. Pivot points 36 are included at the proximal end of at least one and preferably three (3) of the legs. The pivot points 36 preferably employ a standard hinge configuration or other well known in the art mechanism to effectuate rotation of the leg 12. As previously noted, the ability to lower these legs 12 from their elevated position can facilitate storage and transport of the foldable chair. In particular, placement of the foldable chair 10 into a vehicle trunk such that the trunk lid may be closed is greatly facilitated with the leg pivots 36.

Figure 7:
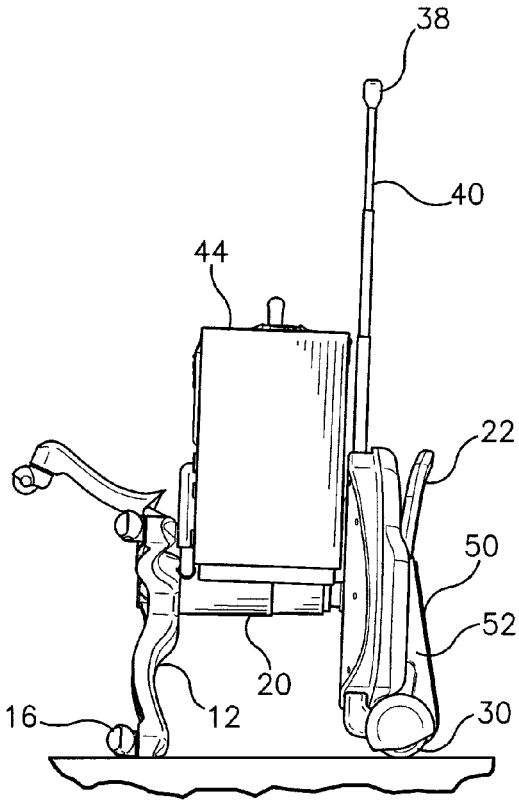
FIG. 7 is a side elevation view of a foldable chair converted to a rolling transport configuration with a carrying case in place and a telescoping handle fully deployed.

FIG. 7 depicts the next phase in the conversion of the foldable chair from the seating configuration to the rolling transport which is the extraction of the handle 38 and telescoping member 40 from the nesting location inside of the first platform 18. The extraction of the handle 38 allows the user to then employ the wheels 30 as pivot points, rotate the entire rolling transport and commence transport of the carrying case 44 and the foldable chair 10. The user can easily transport a carrying case 44 with supplies in excess of 30 pounds with the rolling transport and only experience minimal exertion. FIG. 7 also reveals removable friction strips 50 secured to one or more triangularly shaped support ribs 52 at the rear surface of the backrest 22. The friction strips 50 provide a surface for the rolling transport to slide up and down steps and are preferably coated with a friction reducing material such as Teflon®. The friction strips 50 are preferably secured by screws that are countersunk below the surface of the strip 50. When the strips become excessively worn the retaining screws can be removed and the strips 50 replaced.

Figure 8:
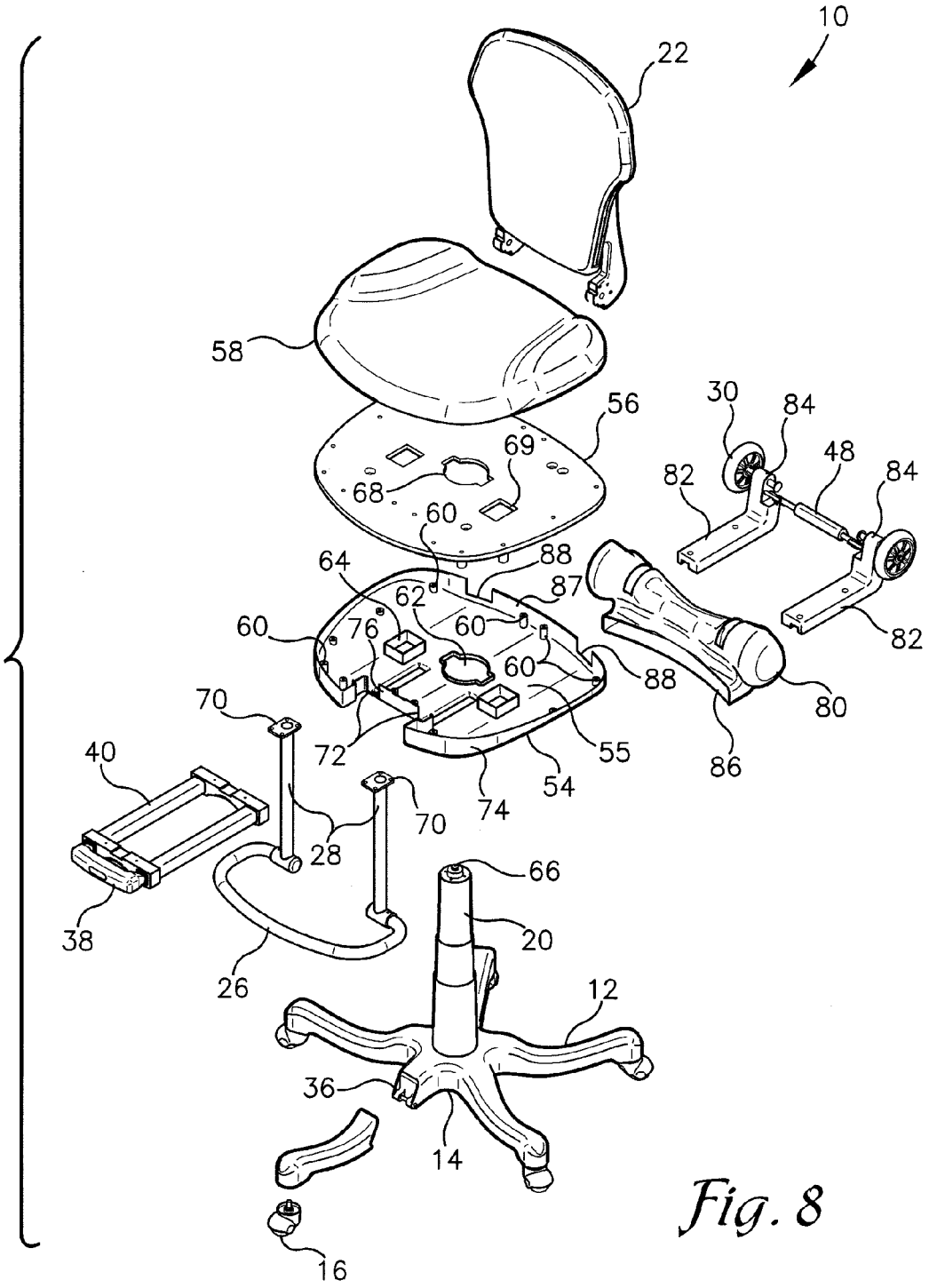
FIG. 8 is an exploded assembly view of a foldable chair in a seating configuration.

FIG. 8 reveals in an exploded view the various major elements of the foldable chair 10. FIG. 8 reveals the elements of the first platform 18. The first platform 18 includes a lower cover shell 54 as well as a partitioning plate 56 that is disposed between the lower cover shell 54 and the first platform cushion pad 58. The lower cover shell 54 includes a series of screw columns 60 through which securing screws are passed into the portioning plate 56 and ultimately into the cushion pad 58 to join the three components together.

FIG. 8 also reveals a series of cutouts in the lower cover shell 54. These cutouts include a support column opening 62 and two support rod cutouts 64. The support column 20 includes a threaded element 66 at the upper most portion of the column that passes through the support column opening 62 in the lower cover shell 54, through the partitioning plate opening 68 and into a nut (not shown) in the underside of the cushion pad 58. The threaded element 66 is then threaded into the cushion pad 58 nut to secure the first platform 18 assembly to the support column 20.

Attachment brackets 70 are preferably weldably secured to the distal end of the support rods 28. The attachment brackets 70 are also preferably comprised of square or rectangular metal plates with a series of holes through which screws can be passed to secure the attachment brackets 70 of the second platform 26 to the underside of the first platform 18. Additionally, the attachment brackets 70 must be sized to be able pass through the support rod cutouts 64 in the lower shell as well as the partitioning plate cutouts 69. The second platform 26 and support rods 28 are preferably comprised of tubular material, preferably aluminum and of sufficient tube wall thickness to prevent plastic deformation or fracturing when the weight of the user's feet are placed on the second platform.

The lower cover shell 54 provides an interior nesting location 55 for the telescoping members 40. When fully assembled, a telescoping rod member 40 is positioned on each side of the support column opening 62. The rod members 40 pass through two cutouts 72 in the front wall 74 of the lower cover shell 54. A backstop 76 limits the inward travel of the handle 38 when the user is returning the rod members to the fully nested position internal to the first platform 18.

FIG. 8 also details the positioning of the wheel cover 80 that can be configured as a single piece or in multiple pieces 80A, 80B if necessary to accommodate manufacturing constraints. As discussed above, the wheel cover 80 shields the user from debris collected on the wheels 30 coming into contact with clothing while seated in the chair. The roller support brackets 82 include a flange element 84 that extends upwardly from the main portion of the support bracket 82. The two roller support brackets 82 are inserted through a lower chamber 86 in the roller cover 80 and then through two separate cutouts 88 in the back wall 87 of the lower cover shell 54. The two roller support brackets 82 extend to the interior of the lower cover shell 54 and are preferably secured in position with two or more screws that extend through both the support brackets 82 and the lower cover shell 54 thereby providing a rigid anchoring of the support brackets 82.

Figure 9:
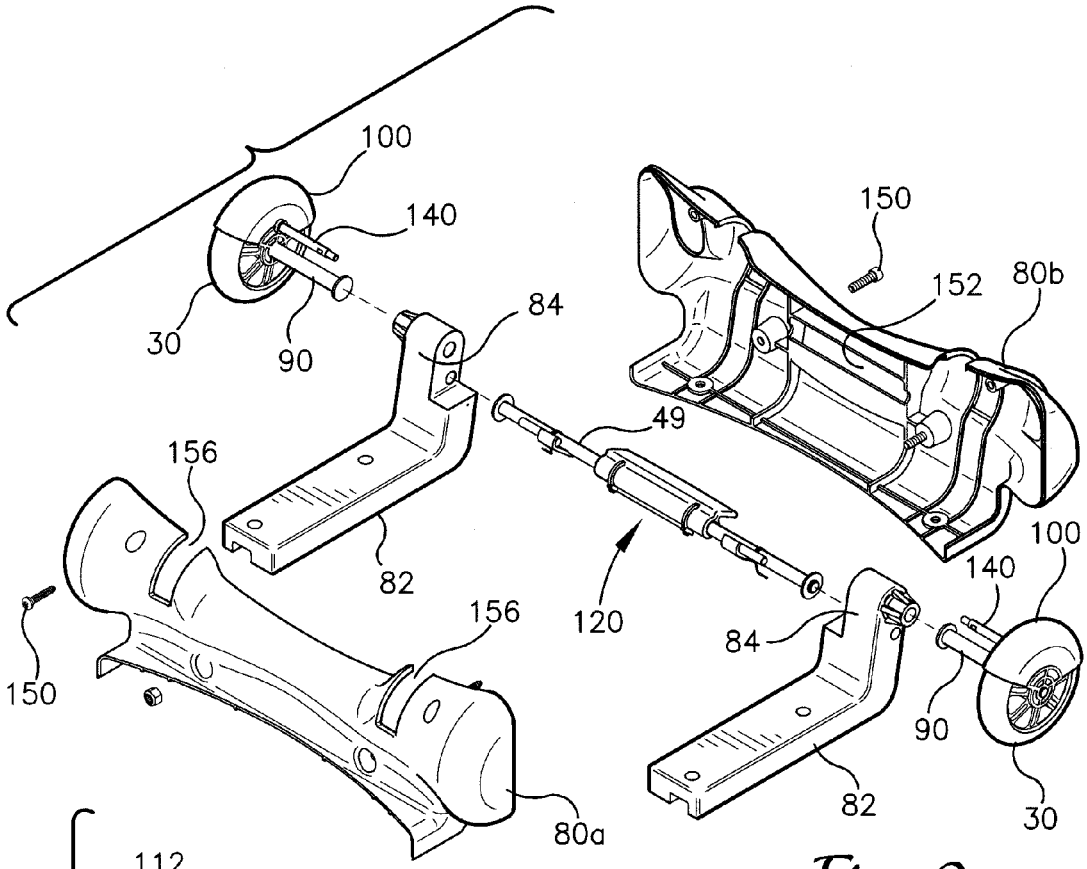
FIG. 9 is an exploded assembly view of handle assembly mechanism.
Figure 10:
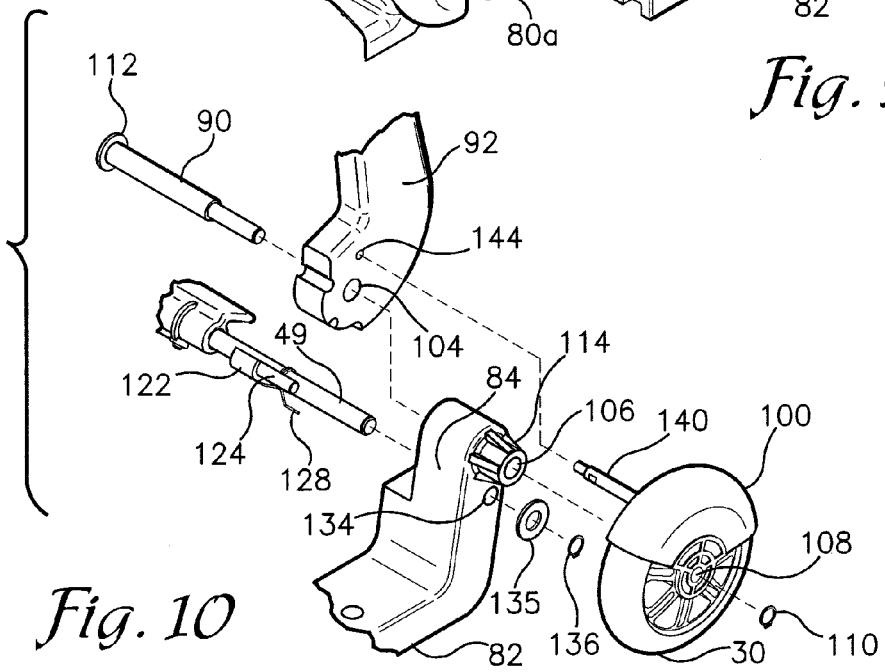
FIG. 10 is an exploded assembly view of the interaction between the handle assembly, roller wheel assembly and backrest bracket.

As seen in FIGS. 9 and 10, the flange elements 84 of the two roller support brackets 82 are each utilized to secure a wheel 30 and the backrest bracket 92 in position. The axle 90, as best seen in FIG. 10, passes through a hole 104 in the backrest bracket, a hole 106 in the flange elements 84, a bushing 114, and ultimately into and through the center 108 of the wheel 30. After passing through the center of the wheel 108 the axle 90 is secured in position by a snap ring 110 or a similar retaining feature. At the opposite end of the axle 90 is an axle flange 112 that restrains the axle from passing through the hole 104 in the backrest bracket 92. As previously mentioned, disposed between the wheel 30 and the flange elements 84 is a bushing 114 that prevents the rubberized portion of the wheel 30 from contacting the flange elements 84 by providing separation distance between the surfaces.

Figure 13:
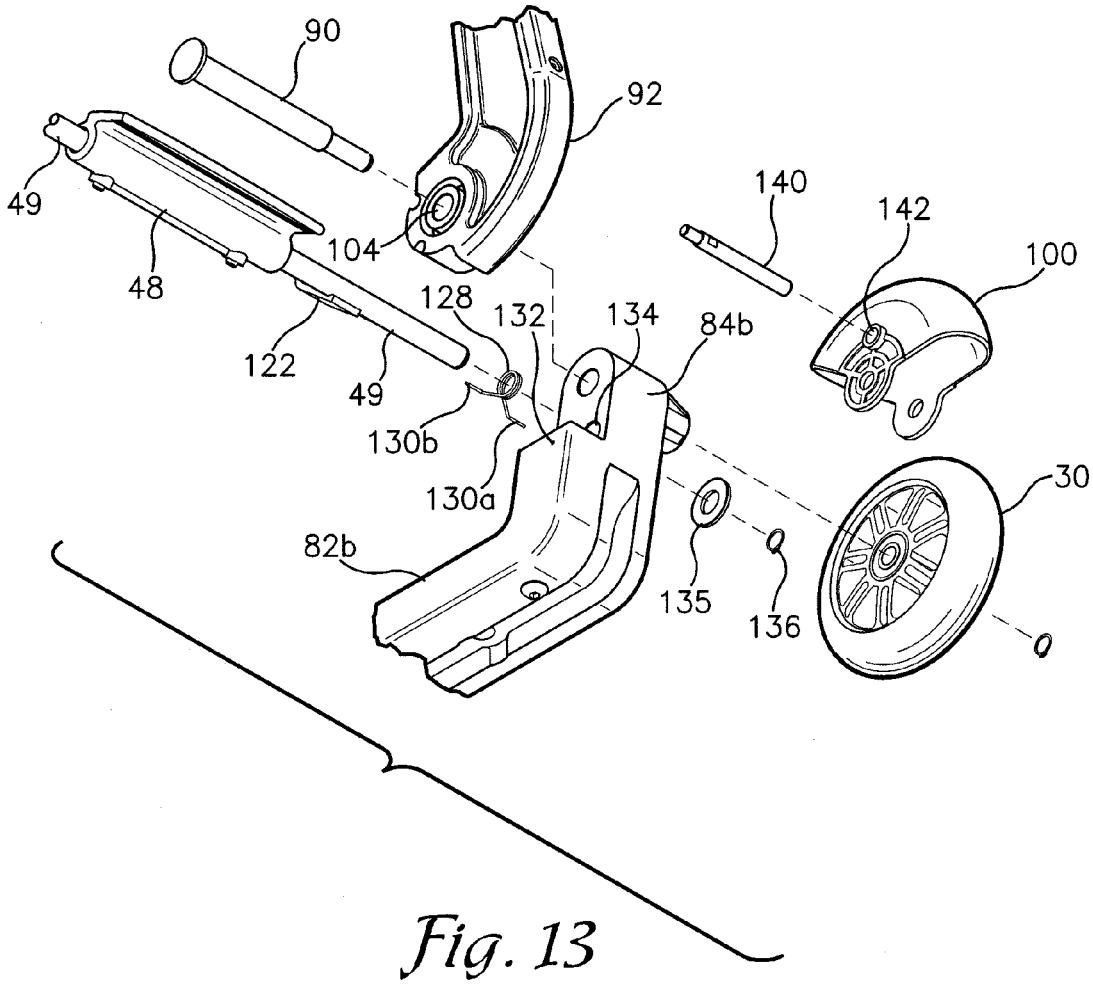
FIG. 13 is an exploded assembly view of a backrest bracket, handle assembly and support bracket.

As best seen in FIGS. 10 and 13, a first end of a pivot rod 140 is secured to the partial shroud 100 at opening 142. This second end of the pivot rod 140 is disposed within an opening 144, as seen on FIG. 10, within the exterior side of the backrest bracket 92. This connection between the partial shroud 100 and the backrest bracket 92 will allow the partial shroud 100 to rotate approximately ninety degrees about the axle 90 when the user rotates the backrest 22 from the upright position to the folded position such that it is resting atop the first platform/seat 18.

Figure 11:
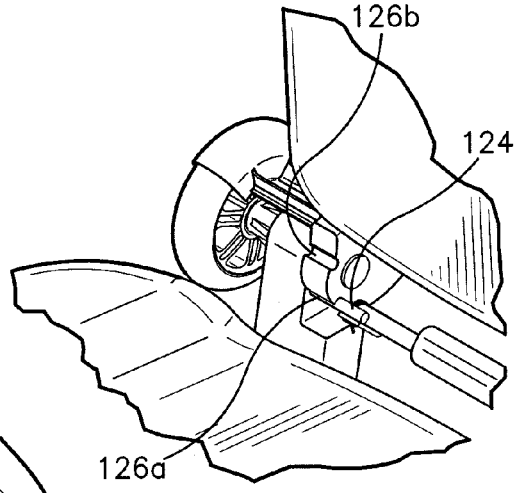
FIG. 11 is a perspective view of the handle assembly, detent rod and backrest bracket notch location.

FIGS. 9 through 13 also provide detail on the backrest 22 release mechanism 120 which is comprised of the backrest release handle 48 secured to a release handle rod 49. The rod 49 preferably has a flat machined into the center section (not shown) so that the handle 48 can be secured in position with set screws. On each side opposite the handle 48 the handle rod 49 has additional flats (not shown) machined into the handle rod 49 to facilitate securement of rod flanges 122. The rod flanges 122 are rigidly secured to the flats, preferably by welding and extend outwardly from the handle 48 and at approximately 180 degrees from the handle 48. Secured to the surface of the rod flanges 122 are detent rods 124 that extend longitudinally beyond the edges of the rod flanges 122 toward the backrest brackets 92. As best seen in FIG. 11, when fully operational, the detent rods 124 are positioned within one of two notches 126A, 126B in the backrest bracket. When the detent rods 124 are positioned in the first notch 126A the backrest 22 in the upright position. When the detent rods 124 are positioned in the second notch 126B the backrest 22 is in the lowered positioned in preparation for rolling transport.

The backrest release mechanism 120 also includes two torsion springs 128. The torsion springs 128 are disposed opposite each of the rod flanges 122 on the handle rod 49 and serve to return the handle 48 to a preset position after the handle 48 has been raised by a user. As best seen in FIG. 13, the torsion springs 128 each include two legs 130A, 130B. The first leg 130A of each torsion spring 128 is secured in a capture hole 132 in the flange element 84 of the support bracket 82. The second leg 130B of the torsion spring 128 is secured atop the rod flange 122 where the leg will rotate along with the rod flange 122 when the user raises the handle 48 with the objective of rotating the backrest 22. When the torsion spring 128 is rotated the spring seeks to return to its original position by applying a force to the rod flange and ultimately to the handle 48. As can be seen in FIGS. 10 and 13, each end of the handle rod 49 passes through a hole 134 in the flange element 84 and exits on the opposite side of the flange element 84 where it is secured in position by a washer 135 and a snap ring 136

As best seen in FIG. 9, the entire handle assembly 120, except for the handle 48, is shielded by the wheel cover pieces 80A, 80B. The two wheel cover pieces 80A, 80B are secured to one another by screws 150 passing though both portions of the cover pieces. The handle 48 extends through an opening 152 at the rear of the cover piece 80B to allow a user to raise the handle 48 thereby withdrawing the detent rods 124 from the notches in the 126A, 126B in the backrest brackets 92. The wheel cover pieces 80A, 80B also contain cutouts 156 to provide an opening for the backrest brackets 92 secured to the flange element 84.

In operation, the user approaches the chair and raises the backrest release handle 48. This action causes the release handle rod 49 to rotate. The rotation of the handle rod 49 causes rotation of the detent rods 124 proximate each of the backrest brackets 92. When the detent rods 124 rotate out of the lower notches 126A, this in turn releases the backrest 22 from its locked position and allows the backrest to rotate forward until generally parallel with the seat. As the backrest bracket 92 rotates the second notch 126B on each backrest bracket advances closer to the detent rod 124 on each side of the chair. As the notches 126B approach the detent rods 124, which are spring loaded due to the torsion springs 128 they snap into position in the notches 126B.

Contemporaneous with the rotation of the backrest downward is the rotation of the partial shroud 100. When the backrest 22 is in the upright position the shroud 100, in conjunction with the roller shroud 32 of the wheel cover assembly 80A, 80B, fully covers the wheels 30. Fully covering the wheels 30 prevents the transfer of any ground debris picked up by the wheels during rolling transport to the user of the chair. As the user seeks to transform the chair into a rolling transport, the rotation of the backrest will result in the rotation of the partial shroud 100 as the pivot rod 140 is connected to the backrest bracket 92. A ninety degree rotation of the backrest into a position parallel with the seat will rotate the partial shroud 100 an equivalent 90 degrees thereby rotating the shroud 100 out of the window of the roller shroud 32. Rotation of the partial shroud out of the roller shroud window permits the wheels 30 to make contact with the ground surface.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

What is claimed is:

1. A foldable chair, operable between a seating configuration and a rolling transport configuration, the foldable chair comprising:

a plurality of legs each comprising a proximal and a distal end, a rolling element secured to the distal end of each leg and the proximal end of each leg secured to a column base;

a column with a first and second end, the column first end secured to the column base;

a first platform, the second end of the column secured to the first platform, the first platform housing at least one telescoping shaft for use as a handle when the foldable chair is in the rolling transport configuration;

a second platform secured to and disposed beneath the first platform for releasably attaching a carrying case for item storage during rolling transport;

a backrest with a first and second edge and a front side and a back side, the backrest rotatably secured to the first platform such that when the backrest is substantially perpendicular to the first platform at least two wheel elements oppositely disposed and adjacent the first and second backrest edges are shrouded and when the backrest is rotated approximately 90 degrees and disposed substantially parallel to the first platform the wheel elements are exposed for contact with the ground surface.

2. The foldable chair of claim 1, wherein the first platform is adjustable in height by adjusting column height.

3. The foldable chair of claim 2, wherein the first platform height is adjustable by the user repositioning a lever in operable communication with a lifting mechanism disposed within the column.

4. The foldable chair of claim 1, wherein the plurality of legs are comprised of a range of legs between 3 and 6.

5. The foldable chair of claim 1, wherein the proximal end of at least one leg is pivotally secured to the column base.

6. The foldable chair of claim 1, wherein the proximal end of at least one leg is non-pivotally secured to the column base.

7. The foldable chair of claim 1, wherein when extended, the at least one telescoping shaft housed in the first platform is adapted to allow the user to rotate the foldable chair in the rolling transport configuration.

8. The foldable chair of claim 1, wherein when in the seating configuration the first platform serves as a seat cushion for the user.

9. The foldable chair of claim 1, wherein when in the seating configuration the second platform serves as a footrest for the user.

10. The foldable chair of claim 1, wherein the second platform is suspended beneath the first platform by at least one support rod.

11. The foldable chair of claim 1, wherein when in the rolling transport configuration the carrying case is secured to the second platform and is disposed atop the column and the at least one support rod.

12. The foldable chair of claim 1, wherein the roller element shroud rotates out of position exposing the roller element when the backrest is lowered into position atop the first platform.

13. The foldable chair of claim 1, wherein at least one low friction strip is removably securable to the backside of the backrest, the at least one low friction strip extending longitudinally along the backside of the backrest.

14. A foldable chair, operable between a seating position and a rolling transport position, the foldable chair comprising:

a plurality of legs each comprising a proximal and a distal end, a roller element secured to the distal end of each leg and the proximal end of each leg secured to a column base;

a column with a first and second end, the column first end secured to the column base;

a first platform, the second end of the column secured to the first platform, the first platform housing at least one telescoping shaft for use as a handle when the foldable chair is in the rolling transport configuration;

a second platform secured to and disposed beneath the first platform for releasably securing a carrying case for item storage and rolling transport;

a backrest with a first and second edge, the backrest rotatably secured to the first platform such that when the backrest is substantially perpendicular to the first platform at least two wheel elements oppositely disposed and adjacent the first and second backrest edges are fully shrouded and when the backrest is disposed substantially parallel to the first platform the shroud retracts and the wheel elements are exposed and available for contact with the ground surface;

when the foldable chair is in a seating configuration the roller elements secured to the distal end of the plurality of legs are in contact with the ground surface, the first platform and the backrest are disposed at substantially a 90 degree angle to one another and the first platform is available as a seat by the user;

when in a rolling transport configuration the backrest and first platform are substantially parallel and the foldable chair is rotated approximately 90 degrees such that the distal end of at least one leg remains in contact with the ground surface and the unshrouded wheel elements contact the ground surface, the carrying case is releasably secured to the second platform and is supported by the column.

15. The foldable chair of claim 14, wherein the first platform is adjustable in height by user manipulation of a column lever that is in operable communication with a lifting mechanism internal to the column.

16. The foldable chair of claim 14, wherein the plurality of legs are comprised of a range of legs between 3 and 5.

17. The foldable chair of claim 14, wherein the proximal end of at least one leg is pivotally secured to the column base.

18. The foldable chair of claim 14, wherein the proximal end of at least one leg is non-pivotally secured to the column base.

19. The foldable chair of claim 14, wherein when extended, the at least one telescoping shaft housed in the first platform is adapted to allow the user to rotate the foldable chair in the rolling transport configuration 20. The foldable chair of claim 14, wherein when in the seating configuration the first platform serves as a seat cushion for the user.

21. The foldable chair of claim 14, wherein when in the seating configuration the second platform serves as a footrest for the user.

22. The foldable chair of claim 14, wherein when in the rolling transport configuration the carrying case is secured to the second platform and is positioned atop the column.

23. The foldable chair of claim 14, wherein the wheel element shroud rotates out of position when the backrest is lowered into position atop the first platform.

24. An apparatus convertible between a seating device and a rolling transport, the apparatus comprising;

(A) when deployed as a seating device;

(i) a plurality of legs each comprising a proximal and a distal end, a roller element secured to the distal end of each leg and the proximal end of each leg secured to a column base;

(ii) a column with a first and second end, the column first end secured to the column base;

(iii) a first platform with an upper side and an lower side, a lower side center mount, at least one telescoping shaft housed within the first platform, the column second end secured to the first platform underside center mount;

(iv) a second platform with a base, the second platform downwardly extending from the first platform lower side; and (v) a backrest with first and second oppositely disposed side edges, the backrest rotatably secured to the first platform wherein when the backrest is substantially perpendicularly disposed to the first platform at least two oppositely disposed wheels adjacent the first and second backrest edges are each fully covered by shroud elements;

(B) when deployed as a rolling transport apparatus;

(i) the backrest is rotated to a position that is substantially parallel to the first platform wherein the shroud elements are rotated out of position and expose the at least two oppositely disposed wheels such that upon contact with the ground surface the wheels may freely rotate;

(ii) the entire apparatus is rotated approximately 90 degrees bringing the at least two oppositely disposed wheels into contact with the ground surface and the distal end of at least one of the plurality of legs remains in contact with the ground surface while the distal end of the remaining plurality of legs are elevated above the ground surface;

(iii) a carrying case is releasably secured to the second platform;

(iv) the telescoping shaft is extracted from the first platform and the telescoping shaft is available during rolling transport to rotate the entire apparatus upon the two unshrouded oppositely disposed wheels; and (v) the plurality of legs elevated above the ground surface are pivotally rotated downward at the column base to reduce the space required for storage and transport of the apparatus.

25. The foldable chair of claim 24, wherein the first platform is adjustable in height by adjusting the column height.

26. The foldable chair of claim 25, wherein the first platform height is adjustable by the user manipulating a lever in operable communication with a lifting mechanism disposed within the column.

27. The foldable chair of claim 24, wherein the plurality of legs are comprised of a range of legs between 3 and 6.

28. The foldable chair of claim 24, wherein the proximal end of at least one leg is pivotally secured to the column base.

29. The foldable chair of claim 24, wherein the proximal end of at least one leg is non-pivotally secured to the column base.

30. The foldable chair of claim 24, wherein when extended, the at least one telescoping shaft housed in the first platform is adapted to allow the user to rotate the foldable chair in the rolling transport configuration

31. The foldable chair of claim 24, wherein when in the seating configuration the first platform serves as a seat cushion for the user.

32. The foldable chair of claim 24, wherein when in the seating configuration the second platform serves as a footrest for the user.

33. The foldable chair of claim 24, wherein when in the rolling transport configuration the carrying case is secured to the second platform and is disposed atop the column.

34. The foldable chair of claim 24, wherein the wheel shroud rotates out of position, exposing the wheels, when the backrest is lowered into position atop the first platform.

* * * * *